US010077488B2

(12) United States Patent
Fujimoto et al.

(10) Patent No.: US 10,077,488 B2
(45) Date of Patent: Sep. 18, 2018

(54) HIGH-STRENGTH, HIGH-DAMPING-CAPACITY CAST IRON

(71) Applicant: Toshiba Kikai Kabushiki Kaisha, Chiyoda-ku, Tokyo (JP)

(72) Inventors: Ryousuke Fujimoto, Numazu (JP); Takumi Hareyama, Morioka (JP)

(73) Assignee: TOSHIBA KIKAI KABUSHIKI KAISHA, Chiyoda-Ku, Tokyo (JP)

( * ) Notice: Subject to any disclaimer, the term of this patent is extended or adjusted under 35 U.S.C. 154(b) by 192 days.

(21) Appl. No.: 14/929,078

(22) Filed: Oct. 30, 2015

(65) Prior Publication Data

US 2016/0053351 A1 Feb. 25, 2016

Related U.S. Application Data

(63) Continuation of application No. PCT/JP2014/062856, filed on May 14, 2014.

(30) Foreign Application Priority Data

May 14, 2013 (JP) ..... 2013-101777

(51) Int. Cl.

| | |
|---|---|
| ***C22C 37/00*** | (2006.01) |
| ***C22C 37/04*** | (2006.01) |
| ***C21D 5/00*** | (2006.01) |
| ***C22C 37/10*** | (2006.01) |
| ***C22C 33/08*** | (2006.01) |

(52) U.S. Cl.

CPC ..... *C22C 37/04* (2013.01); *C21D 5/00* (2013.01); *C22C 33/08* (2013.01); *C22C 37/00* (2013.01); *C22C 37/10* (2013.01)

(58) Field of Classification Search

CPC ..... C22C 37/00; C22C 37/04; C22C 37/10

See application file for complete search history.

(56) References Cited

U.S. PATENT DOCUMENTS

| | | | |
|---|---|---|---|
| 2,885,285 | A | 5/1959 | Dickinson |
| 4,244,754 | A | 1/1981 | Masumoto |
| 4,299,622 | A | 11/1981 | Kimira |

(Continued)

FOREIGN PATENT DOCUMENTS

| | | |
|---|---|---|
| CH | 594057 A5 | 12/1977 |
| CN | 101851723 | 10/2010 |

(Continued)

OTHER PUBLICATIONS

Search Report of International Application No. PCT/JP2008/051410 dated May 13, 2008.

(Continued)

*Primary Examiner* — Matthew E Hoban

(74) *Attorney, Agent, or Firm* — DLA Piper LLP US

(57) ABSTRACT

A high-strength, high-damping-capacity cast iron having both a high strength and high vibration damping capacity is provided.

The high-strength, high-damping-capacity cast iron is obtained by a method including performing a graphite spheroidizing treatment on a molten metal, and consists of 2% to 4% of C, 1% to 5% of Si, 0.2% to 0.9% of Mn, 0.1% or less of P, 0.1% or less of S, 3% to 7% of Al, 0% to 1% of Sb, 0% to 0.5% of Sn, 0.02% to 0.10% of Mg, 01% to 0.5% of RE (Ce, La), Fe as balance, and unavoidable impurity.

16 Claims, 3 Drawing Sheets

(56) References Cited

U.S. PATENT DOCUMENTS

| | | | | |
|---|---|---|---|---|
| 4,548,643 | A | 10/1985 | Betts | |
| 2003/0116113 | A1 | 6/2003 | Ward | |
| 2004/0016530 | A1 | 1/2004 | Schoen | |
| 2006/0191604 | A1* | 8/2006 | Itoh | C22C 37/04 148/321 |

FOREIGN PATENT DOCUMENTS

| | | | |
|---|---|---|---|
| CN | 102560228 | | 7/2012 |
| DE | 1190481 | A | 4/1965 |
| DE | 000001800447 | B1 | 5/1970 |
| DE | 2 132 417 | | 1/1973 |
| DE | 000001800447 | C2 | 4/1976 |
| DE | 2630141 | | 2/1977 |
| DE | 3509709 | A1 | 9/1985 |
| DE | 10144167 | C1 | 2/2003 |
| EP | 1865082 | * | 12/2007 |
| EP | 1865082 | A1 | 12/2007 |
| JP | 51-133123 | | 11/1976 |
| JP | 55-152149 | | 11/1980 |
| JP | 63-140064 | | 6/1988 |
| JP | 1-283341 | | 11/1989 |
| JP | 9-78179 | | 3/1997 |
| JP | 2000-104138 | | 4/2000 |
| JP | 2001-200330 | | 7/2001 |
| JP | 2002-146468 | | 5/2002 |
| JP | 2002-348634 | | 12/2002 |
| JP | 2005-513268 | | 5/2005 |
| JP | 2008-223135 | | 9/2008 |
| JP | 2009-287103 | | 12/2009 |
| JP | 2011-012322 | | 1/2011 |
| JP | 5268344 | B2 | 8/2013 |
| KR | 2001-0054925 | | 7/2001 |

OTHER PUBLICATIONS

English language abstract of JP-51-133123 published Nov. 18, 1976.
English language abstract of JP-55-152149 published Nov. 27, 1980.
English Abstract of JP 63 140064 published Jun. 11, 1988.
English Abstract of JP 2001-200330 published Jul. 24, 2001.
English Translation of JP 2001-200330 published Jul. 24, 2001.
English Abstract of JP 2002-348634 published Dec. 4, 2002.
English Translation of JP 2002-348634 published Dec. 4, 2002.
International Preliminary Report on Patentability (IPRP) & Written Opinion issued in PCT/JP2008/051410 dated Aug. 19, 2009.
English Translation of International Preliminary Report on Patentability (IPRP) & Written Opinion issued in PCT/JP2008/051410 dated Aug. 19, 2009.
International Search Report issued in PCT/JP2009/058705 dated Aug. 11, 2009.
English Language Translation of International Search Report issued in PCT/JP2009/058705 dated Aug. 11, 2009.
Naoki Sakamoto et al., "Al o Tenka shita Henjo Kokuen Chutetsu no Young-ritsu to Taisu Gensuiritsu no Henka", Dai 150 Kai Zenkoku Koen Taikai Koen Gaiyoshu, May 1, 2007, p. 46.
Ryosuke Fujimoto et al., "Al o Tenka shita Henjo Kokuen Chutetsu no Young-ritsu to Taisu Gensuiritsu no Henka", Dai 150 Kai Zenkoku Koen Taikai Koen Gaiyoshu, May 1, 2007, p. 47.
Tsutomu Kurikuma et al., Effects of Graphite Morphology and Matrix Microstructure on Damping Capacity, Tensile Strength and Young's Modulus of Casting Irons, Chuzo Kogaku, 1996, vol. 68, No. 10, pp. 876-882.
Abstract of Tsutomu Kurikuma et al., Effects of Graphite Morphology and Matrix Microstructure on Damping Capacity, Tensile Strength and Young's Modulus of Casting Irons, Chuzo Kogaku, 1996, vol. 68, No. 10, pp. 876-882.
English Abstract of JP 1-283341 published Nov. 14, 1989.
English Abstract of JP 9-78179 published Mar. 25, 1997.
English Translation of JP 9-78179 published Mar. 25, 1997.
English Abstract of JP 2008-223135 published Sep. 25, 2008.
English Translation of JP 2008-223135 published Sep. 25, 2008.
German Office Action issued in DE 11 2008 000 392.0-24 dated Nov. 25, 2010.
English Translation of German Office Action issued in DE 11 2008 000 392.0-24 dated Nov. 25, 2010.
English Language Abstract of De 2132417 published Jan. 11, 1973.
U.S. Appl. No. 12/540,419.
U.S. Appl. No. 12/940,140.
Korean Office Action issued in KR 10-2011-7019647 published on Nov. 10, 2011.
English Language Translation of Korean Office Action issued in KR 10-2011-7019647 published on Nov. 10, 2011.
English Language Abstract of JP 2005-513268 published on May 12, 2005.
English Language Translation of JP 2005-513268 published on May 12, 2005.
German Office Action dated Jan. 23, 2012 in DE 11 2009001294.9.
English Language Translation of German Office Action dated Jan. 23, 2012 in DE 11 2009001294.9.
English Language Abstract of DE 2630141 published on Feb. 3, 1977.
English Language Abstract of KR 2001-0054925 published Jul. 2, 2001.
English Language Translation of International Preliminary Report on Patentability and Written Opinion issued in PCT/JP2009/058705 dated Feb. 1, 2011.
U.S. Appl. No. 14/015,760.
Japanese Office Action issued in JP 2008-142932 dated Dec. 17, 2013.
English Language Translation of Japanese Office Action issued in JP 2008-142932 dated Dec. 17, 2013.
English Language Abstract of JP 5268344 published Aug. 21, 2013.
International Preliminary Report on Patentability and Written Opinion issued in PCT/JP2014/062856 dated Nov. 26, 2015.
German Office Action with partial English translation issued in DE112014002442.2 dated Feb. 16, 2016.
International Search Report issued in PCT/JP2014/062856 dated Aug. 19, 2014.
English language Abstract and Translation of JP 2011-012322 published on Jan. 20, 2011.
English language Abstract and Translation of JP 2009-287103 published on Dec. 10, 2009.
English language Abstract and Translation of JP 2002-146468 published on May 22, 2002.
English language Abstract and Translation of JP 2000-104138 published on Apr. 11, 2000.
English language Abstract and Translation of CN 102560228 published on Jul. 11, 2012.
English language Abstract and Translation of CN 101851723 published on Oct. 6, 2010.
English language Abstract and Translation of EP 1865082 A1 published on Dec. 12, 2007.
English language Abstract and Translation of DE 10144167 C1 published on Feb. 20, 2003.
English language Abstract and Translation of DE 3509709 A1 published on Sep. 26, 1985.
English language Abstract and Translation of CH 594057 A5 published on Dec. 30, 1977.
English language Translation of DE 1190481 A published on Apr. 8, 1965.
English language translation of DE 1800447 B1 published on May 27, 1970.
German Office Action issued in DE 11 2014 002 442.2 dated Jul. 4, 2018.

* cited by examiner

HIGH-STRENGTH, HIGH-DAMPING-CAPACITY CAST IRON

CROSS-REFERENCE TO RELATED APPLICATIONS

This is a Continuation Application of PCT Application No. PCT/JP2014/062856, Filed May 14, 2014 which was published under PCT Article 21(2) in Japanese, and based upon and claims the benefit of priority from Japanese Patent Application No. 2013-101777, filed May 14, 2013; the entire contents of all of which are incorporated herein by reference.

BACKGROUND OF THE INVENTION

1. Field of the Invention

The present invention relates to high-strength, high-damping-capacity cast iron having a high strength and high vibration damping capacity.

2. Description of the Related Art

Presently, noise is at a higher rank of complaints for seven major types of pollution, i.e., air pollution, water pollution, soil pollution, vibration, noise, land subsidence, and bad smell. Of complaints for noise, construction work noise accounts for a high proportion. Since complaints like these concentrate in urban areas, it is of urgent necessity to reduce noise of urban construction machinery. Also, as environmental friendliness tends to be regarded as important worldwide, the EU noise regulations including sales regulations are becoming stricter. As such, noise reduction cannot catch up to the enforcement of noise regulations by extending existing technologies. There is a tendency to view low-noise vehicles as a world-standard for vehicles to hereafter comply with the global trend of regarding environmental friendliness as important. Construction machines are already required to reduce noise to such an extent as that of automobiles, and attempts have been made to reliably reduce noise of engines, fans, mufflers, and the like. Hereinafter, noise reduction of the entire hydraulic system need be dealt with.

To accomplish noise reduction of a hydraulic system, it can be conceived to have the material of heavy machinery hydraulic parts possess vibration damping performance. However, flaky graphite cast iron, which exhibit vibration damping performance (a noise reducing effect), has too low a strength for applying to heavy machinery hydraulic parts made of cast-iron. Therefore, a material having strength relevant to that of conventionally used spheroidal graphite cast iron is necessary.

More specifically, in heavy machinery hydraulic parts, noise is generated at a control valve, motor cover, or the like, and this noise becomes relatively apparent as the engine noise of the heavy machine is reduced. All of such parts are made of spheroidal graphite cast iron or CV (Compacted Vermicular) graphite cast iron, and their strengths are 400 to 500 MPa. By contrast, it is difficult to obtain strength of 350 MPa or more for flaky graphite cast iron.

Patent documents 1 and 2 describe high-rigidity, high-damping-capacity cast iron having high vibration damping capacities. However, these cast iron are flaky cast iron, and therefore their strength is insufficient.

Patent document 3 describes cast iron containing fine-size graphite, which is obtained by adding a rare earth-Si-iron alloy. This cast iron described in patent document 3 is relevant to FC200-class cast iron, in which its vibration damping capacity has been improved without decreasing its strength. However, the strength of this cast iron is only about that of FC200.

Patent document 4 describes a cast iron material which exhibits excellent vibration damping capacity by having fine pores in addition to flaky graphite. In this cast iron material, the vibration damping capacity can be improved by increasing the porosity in a base structure. As a consequence though, the strength decreases as the porosity increases.

The object of patent document 5 is to obtain a cast iron material excellent in both vibration damping capacity and strength. This document describes that the vibration damping capacity is raised by dispersing steadite together with flaky graphite.

None of the high-damping-capacity cast iron described in patent documents 1 to 5 have strength of 400 MPa or more required for heavy machinery hydraulic parts of construction machines, however.

PRIOR ART DOCUMENTS

Patent Documents

Patent Document 1: Jpn. Pat. Appln. KOKAI Publication No. 2008-223135

Patent Document 2: Jpn. Pat. Appln. KOKAI Publication No. 2009-287103

Patent Document 3: Jpn. Pat. Appln. KOKAI Publication No. 2002-146468

Patent Document 4: Jpn. Pat. Appln. KOKAI Publication No. 2001-200330

Patent Document 5: Jpn. Pat. Appln. KOKAI Publication No. 2000-104138

BRIEF SUMMARY OF THE INVENTION

An object of the present invention is to provide a high-strength, high-damping-capacity cast iron having both a high strength and high vibration damping capacity.

The high-strength, high-damping-capacity cast iron according to an aspect of the present invention is characterized by consisting of 2% to 4% of C, 1% to 5% of Si, 0.2% to 0.9% of Mn, 0.1% or less of P, 0.1% or less of S, 3% to 7% of Al, 0% to 1% of Sb, 0% to 0.5% of Sn, 0.02% to 0.10% of Mg, 0% to 0.5% of RE, Fe as balance, and unavoidable impurity. Here, % indicates wt % (or mass %). Also, RE means rare earth and consists of Ce (cerium) and/or La (lanthanum).

In the manufacture of this spheroidal graphite cast iron, spheroidal graphite cast iron and CV graphite cast iron are obtained by spheroidizing graphite by a spheroidizing treatment. As the graphite spheroidizing treatment, it is possible to use all well-known spheroidizing treatments such as an in-mold treatment (a sandwiching method), a tundish method, and wire treatment method. For example, in the in-mold method, which is often used in general, the graphite spheroidizing treatment is performed as follows. First, a reaction groove (pocket) at a bottom portion of a ladle is filled with a spheroidizing agent and completely covered with a covering agent (scrap iron, Fe—Si, or the like). After that, the spheroidizing treatment is performed by pouring molten metal at 1,400° C. to 1,500° C. into this ladle. In this spheroidizing treatment, a general spheroidizing agent containing Mg and RE (Ce, La) can be used.

Also, the strength can be increased by adding an inoculant containing 0% to 0.01% of Ca and/or 0% to 0.01% of Ba to the molten metal.

Furthermore, the base structure may also be modified and made uniform by heat treatment (quenching, normalizing, or annealing) at 900° C. or more. As a result of this heat treatment the vibration damping performance of spheroidal graphite cast iron can be further improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principle of the invention.

DETAILED DESCRIPTION OF THE INVENTION

According to an embodiment of the present invention, both a high strength and high vibration damping capacity can be achieved as cast. In addition, the vibration damping capacity improving effect can be stabilized by performing heat treatment. More specifically, it is possible to obtain high-strength, high-damping-capacity cast iron which exhibit high strength while having a vibration damping capacity around the same level as that of conventional flaky graphite cast iron, which has excellent vibration damping capacity. This embodiment provides Al-added spheroidal graphite cast iron having high strength and high damping capacity, which is obtained by casting cast iron having the above-described composition by using a method including a graphite spheroidizing treatment. This Al-added spheroidal graphite cast iron has, for example, a base structure as shown in a structure photograph of FIG. 1.

Figure 1:
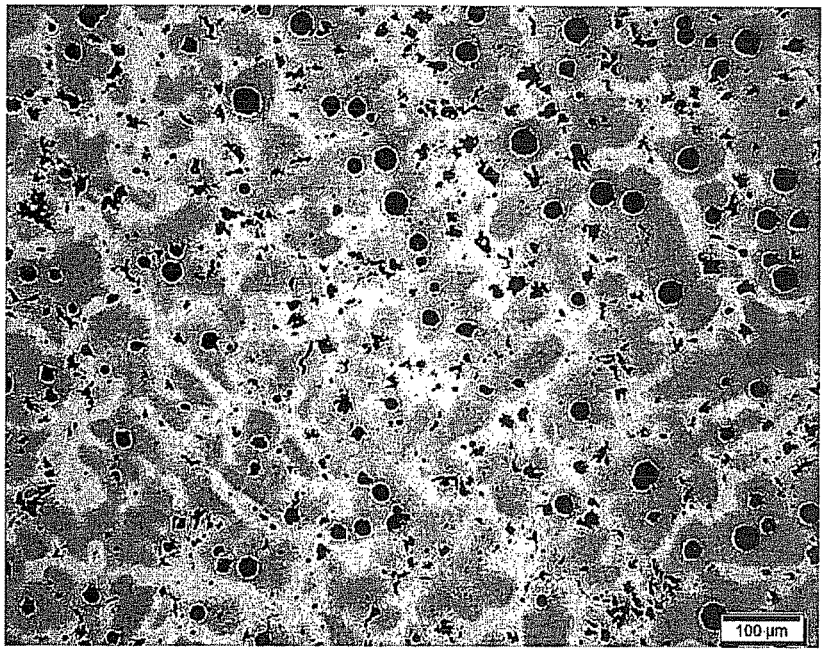
FIG. 1 is a structure photograph of Al-added spheroidal graphite cast iron according to an embodiment of the present invention.

Control of graphite shape is essential for increasing strength. It is necessary to suppress the formation of flaky graphite which causes strength reduction, such that graphite within cast iron would be spheroidal graphite or spheroidal graphite+CV graphite. In FIG. 1, black circular portions indicate spheroidal graphite, and black small lumps indicate CV graphite.

Also, when Al (aluminum) is added into graphite cast iron, Fe—Al carbide is formed in the base structure. This Fe—Al carbide increases the vibration damping capacity of cast iron. In FIG. 1, a gray portion is the Fe—Al carbide, and it can be confirmed that this is included in greater amount relative to a ferrite base structure (white portion).

That is, when used as cast iron parts requiring high strength, for example, heavy machinery hydraulic parts, automobile structural materials, or the like, the cast iron according to the embodiment of the present invention increases the damping property of the parts or materials. Therefore, it is effective for noise suppression. In addition, since this cast iron includes a large amount of Al, its oxidation resistance at high temperatures is presumably more excellent than that of ordinary cast iron.

Figure 2:
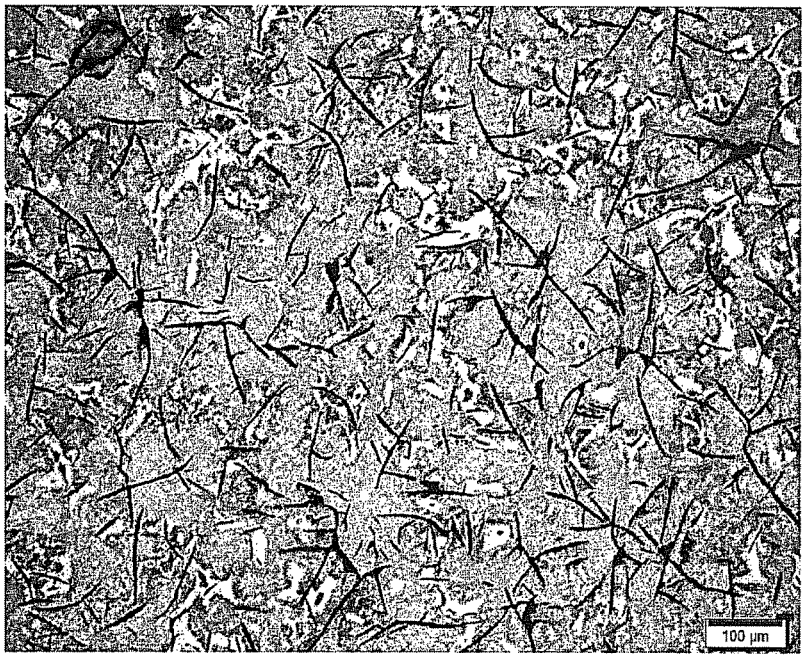
FIG. 2 is a structure photograph of conventional Al-added flaky graphite cast iron.

FIG. 2 shows a structure photograph of Al-added flaky graphite cast iron. Like Al-added spheroidal graphite cast iron, most of the base structure of Al-added flaky graphite cast iron is Fe—Al carbide. As indicated by its name, however, Al-added flaky graphite cast iron includes graphite that is flaky. In FIG. 2, black elongated portions are flaky graphite. As shown in FIG. 2, flaky graphite consists of continuously spread thin flakes. Flaky graphite induces a notch effect because it has such a shape, and decreases the mechanical strength of cast iron. As such, flaky graphite causes strength reduction in graphite cast iron, and therefore, graphite needs to be spheroidized.

In Al-added graphite cast iron, while the formation of Fe—Al carbide by the addition of Al improves the vibration damping capacity, Al is also an element which obstructs spheroidization of graphite. The Al addition amount is 3% to 10%, and preferably, 3% to 7%. As the amount of Al added to cast iron is gradually increased, the vibration damping capacity of the base structure starts improving at the point at which the Al addition amount reaches 3%. However, the vibration damping capacity rather becomes lower when the addition amount exceeds 7%. Also, spheroidization of graphite is obstructed as Al is added, and strength decreases, as described above. Therefore, excess Al addition is not preferable.

The inventors of the present invention, however, have found that when Si (silicon), Sb (antimony), or Sn (tin) is added at an appropriate amount relative to Fe—Al carbide formed in the base structure, both the formation of Fe—Al carbide and the spheroidization of graphite are promoted. Based on this finding, the present inventors have discovered that by adding appropriate amount of Si, Sb, or Sn to Al-added graphite cast iron, increased strength can be realized while having vibration damping capacity. That is, when appropriate amount of Si, Sb, or Sn is added, the vibration damping capacity and strength of Al-added graphite cast iron improve with the addition of Al, even if the addition amount of Al exceeds 7%. If the Al addition amount exceeds 10%, however, there is a possibility that Fe—Al intermetallic compound forms, which is unfavorable because the cast iron becomes very brittle.

Note that the mechanism of improving vibration damping capacity of flaky graphite cast iron by addition of Al can be explained by the theory that the improvement is due to the formation of an iron alloy in which Al is solid-solutioned, or by the theory that the improvement is due to the formation of Fe—Al carbide. In either theory, it is presumed that the vibration damping capacity improves by the ferromagnetic damping mechanism of such substances formed by the addition of Al. The vibration damping capacity of Al-added spheroidal graphite cast iron according to the embodiment of the present invention is thought to improve by the damping mechanism of Fe—Al carbide in the same manner as in the latter theory.

Sb content is defined to be 0% to 1% and Sn content is defined to be 0% to 0.5% for the reasons described below. Even when neither Sb nor Sn is added, cast iron exhibits vibration damping performance because Fe—Al carbide forms. As described above, however, by the addition of Sb or Sn, a strength increasing effect and vibration damping capacity improving effect by graphite spheroidization is achieved. Thus, the performance of cast iron is improved. As the addition amounts of Sb and Sn are increased, effects of improving strength and vibration damping capacity appear when the addition amount of Sb is about 0.2% and that of Sn is about 0.1%. The effects appear most significantly when the addition amount of Sb is about 0.5% and that of Sn is about 0.1%. When the addition amount of Sb or Sn becomes greater, the effects gradually diminish. If Sb exceeds 1% or Sn exceeds 0.5%, no improving effect is obtained. Also, if the addition amount of Sb or Sn is great, a defect such as shrinkage readily occurs in cast iron. Note that even when neither Sb nor Sn is added, about 0.01% of Sb or Sn may be included as an unavoidable component in cast iron. When Sb and Sn are intentionally added, therefore, the content of Sb would normally be 0.01% or more, and that of Sn would normally be 0.01% or more.

The mechanism of the improving effect by addition of Sb or Sn is thought to be as follows. As described above, when Al is added to cast iron, Fe—Al carbide is formed by reaction of iron, Al, and carbon. Also, since Fe—Al carbide is a ferromagnetic substance, it exhibits a ferromagnetic vibration damping mechanism. According to the present inventors' research, the amount of Fe—Al carbide increases as the addition amount of Al is increased. However, the amount of Fe—Al carbide ceases to increase at an Al addition amount of about 6%. Strictly speaking, the formation amount of Fe—Al carbide increases until the Al addition reaches 7%. However, the proportion of the increase in the amount of Fe—Al carbide relative to the increase in Al addition amount is lower when the Al addition amount exceeds 6%, as compared to that when the Al addition amount is 6% or less. In addition, it is unfavorable for the Al addition amount to be in this region because the base structure becomes very hard. When Sb or Sn is added, however, a greater amount of Fe—Al carbide is formed compared to the addition of Al alone. As such, it is thought that the vibration damping capacity improving effect appears because the amount of Fe—Al carbide increases. Furthermore, although the addition of Al forms chunky graphite, the addition of Sb or Sn can suppress the formation of this chunky graphite. However, when addition amount of Sb or Sn becomes excess, the spheroidization of graphite is obstructed. Accordingly, an optimum base structure and optimum graphite structure are obtained within the above-mentioned addition amount range.

Cast iron containing spheroidal graphite and CV graphite has strength more excellent than that of conventional flaky graphite for the following reason. In flaky graphite cast iron, a notch effect is induced because flaky graphite in the base structure is shaped like a continuously spreading thin flake. This notch effect causes the mechanical strength of flaky graphite cast iron to decrease. When graphite is spheroidized, the continuous shape of graphite is lost, and the notch effect disappears. Therefore, in cast iron in which graphite is spheroidized, mechanical strength can be secured. Especially when the spheroidization ratio, which is the number ratio in which spheroidal graphite and CV graphite formed by spheroidization account for among the graphite included in cast iron, is 40% or more, the cast iron strength improving effect by spheroidization of graphite appears. Note that the spheroidization ratio of graphite mentioned herein is defined in JIS G 5520 (2001).

Aside of the above described Al, Sb, and Sn, high-strength, high-damping-capacity cast iron of the embodiment of the present invention includes C, Si, Mn, P, S, Mg, and RE (Ce, La).

In Al-added graphite cast iron, C has influence on the formation of graphite and Fe—Al carbide, and Si has influence on graphite shape. The content of C should be 2% to 4% as in the case of conventional spheroidal graphite cast iron. Si can be added at 1% to 5%. However, when Al is added to graphite cast iron including Si, spheroidization of graphite is obstructed, and chunky graphite forms. The addition amount of Si is preferably 1% to 2%, since Si causes chunky graphite to form. In the case that addition amount of Si is 1.0% or less, it is not preferable because cast iron readily shrinks.

The content of Mn should be 0.2% to 0.9% as in the case of conventional spheroidal graphite cast iron. At Mn content of 0.2% or more, the strength and hardness of cast iron increase. On the other hand, if the content of Mn exceeds 0.9%, large bulky cementite forms in a final solidified portion, and therefore mechanical properties decrease.

The content of P should be controlled to be 0.1% or less as in the case of conventional spheroidal graphite cast iron. The reason for this is because if the content of P exceeds 0.1%, P reacts with iron and forms steadite, which is a hard compound, thereby making cast iron brittle.

The content of S should be controlled to be 0.1% or less as in the case of conventional spheroidal graphite cast iron. The reason for this is because if the S content exceeds 0.1%, S obstructs graphite spheroidization and causes strength to decrease.

The addition amount of Mg should be 0.02% to 0.10% at which spheroidization becomes possible. An Mg addition amount of 0.10% or more is impractical because the spheroidization of graphite is obstructed, and the reaction during casting becomes violent.

Although spheroidal graphite is formed even when no RE (Ce, La) is added, RE forms a nucleus for graphite formation, and so the addition amount should be 0.001% to 0.500%. However, at an addition amount of 0.001% or less, the spheroidization ratio of graphite decreases, and at an addition amount of 0.050% or more, the formation of chunky graphite is promoted in a thick cast product. Therefore, the addition amount is preferably 0.001% to 0.050%. It is generally known that Ce and La are effective as RE for forming a compound that becomes a nucleus of graphite. In the embodiment of the present invention, either Ce or La may be used. Ce or La may be used singly, or Ce and La may be used together at an arbitrary ratio. Note that, as in conventional cast iron, whether it is the case that Ce or La is used singly or it is the case that both are used together (at any ratio) has no influence on the result of graphite spheroidization.

Although the addition of Ca or Ba is not a requirement, when 0.0001% to 0.01% of Ca and/or Ba are added, strength further increases due to an inoculating effect. An addition amount of 0.01% or more promotes the generation of dross during casting or the crystallization of chunky graphite in a thick cast product, and therefore is unfavorable. Note that either one of Ca or Ba may be used singly, or used together at an arbitrary ratio. Also, the inoculating effect is highest immediately after inoculation, in general. Late inoculation by which an inoculant is added in the latter half of pouring is more effective, examples thereof including a melt inoculation method such as a stream inoculation method or an in-mold inoculation method.

Although cast iron having the above-described chemical composition has both a high strength and a high damping capacity as cast, by performing heat treatment such as annealing on this cast iron at 900° C. or more, vibration damping performance improves further. The reason that the vibration capacity improves by high-temperature heat treatment is because the base structure is modified and made uniform. Structure control is performed by heat treatment at about 800° C. for ordinary cast iron. In the present invention, however, the eutectoid temperature is raised because a large amount of Al is added. Therefore, a heat treatment temperature of 900° C. or more is necessary. Also, by raising the heat treatment temperature, Fe—Al carbide is made uniform and made fine, therefore the vibration damping capacity of cast iron further improves. Accordingly, vibration damping performance can be improved even further by heat treatment at 950° C. or 1,000° C. or more.

Figure 3:
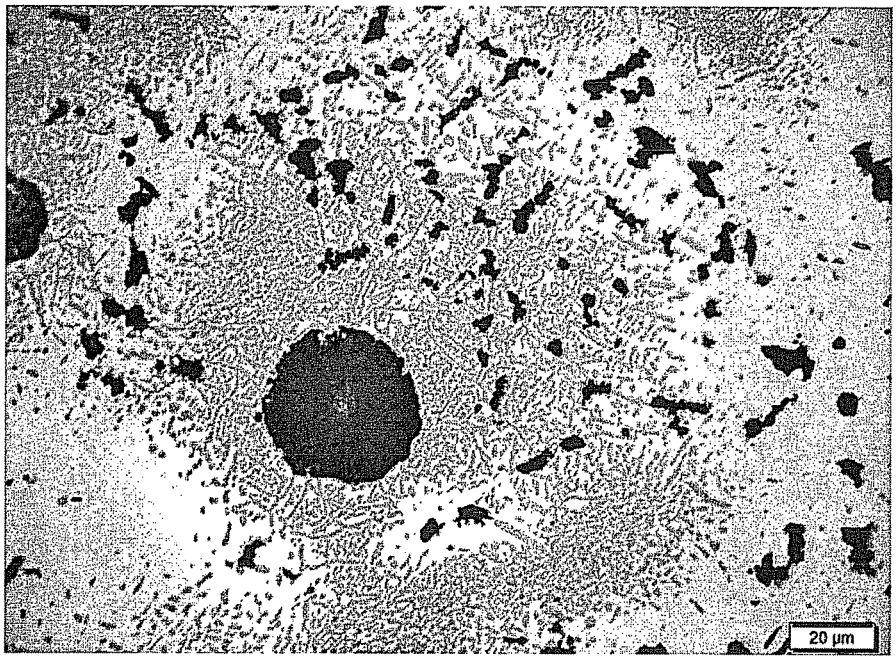
FIG. 3 is a structure photograph of Al-added spheroidal graphite cast iron according to an embodiment of the present invention, in which annealing has not been performed.
Figure 4:
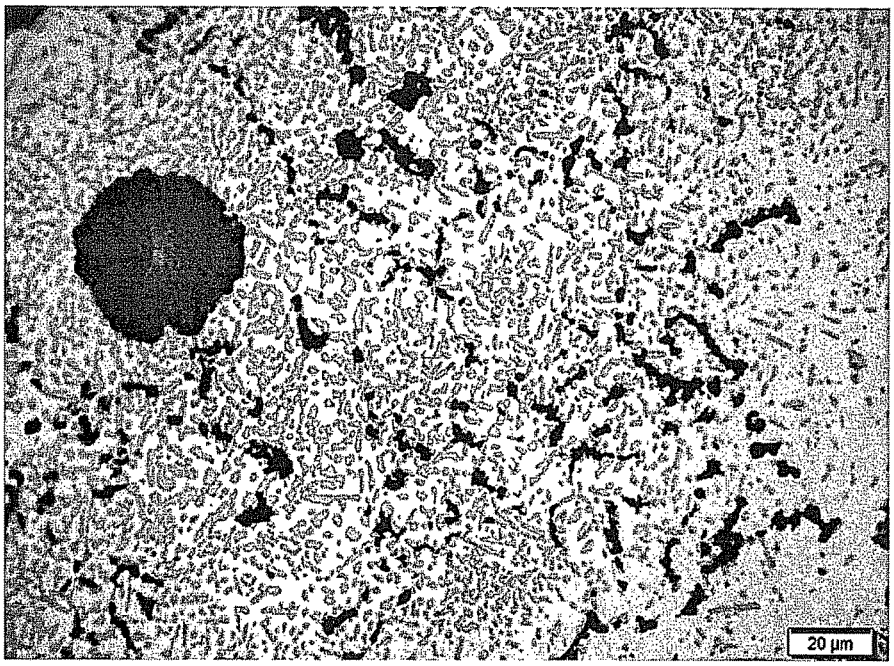
FIG. 4 is a structure photograph of Al-added spheroidal graphite cast iron according to an embodiment of the present invention, which has been annealed at 1,000° C.

FIG. 3 shows a structure photograph of the base structure of Al-added spheroidal graphite cast iron, which has not been annealed. FIG. 4 shows a structure photograph of the base structure of Al-added spheroidal graphite cast iron annealed at 1,000° C. By comparing the base structures shown in FIG. 3 and FIG. 4, it can be confirmed that Fe—Al carbide is made fine by annealing and distributed more uniformly throughout the entire region of the base structure.

According to an aspect of the present invention, a part of a construction machine or the like, which includes one or more high-strength, high-damping-capacity cast iron is provided. A part including the cast iron according to the embodiment of the present invention is, for example, a heavy machinery hydraulic part.

Figure 5:
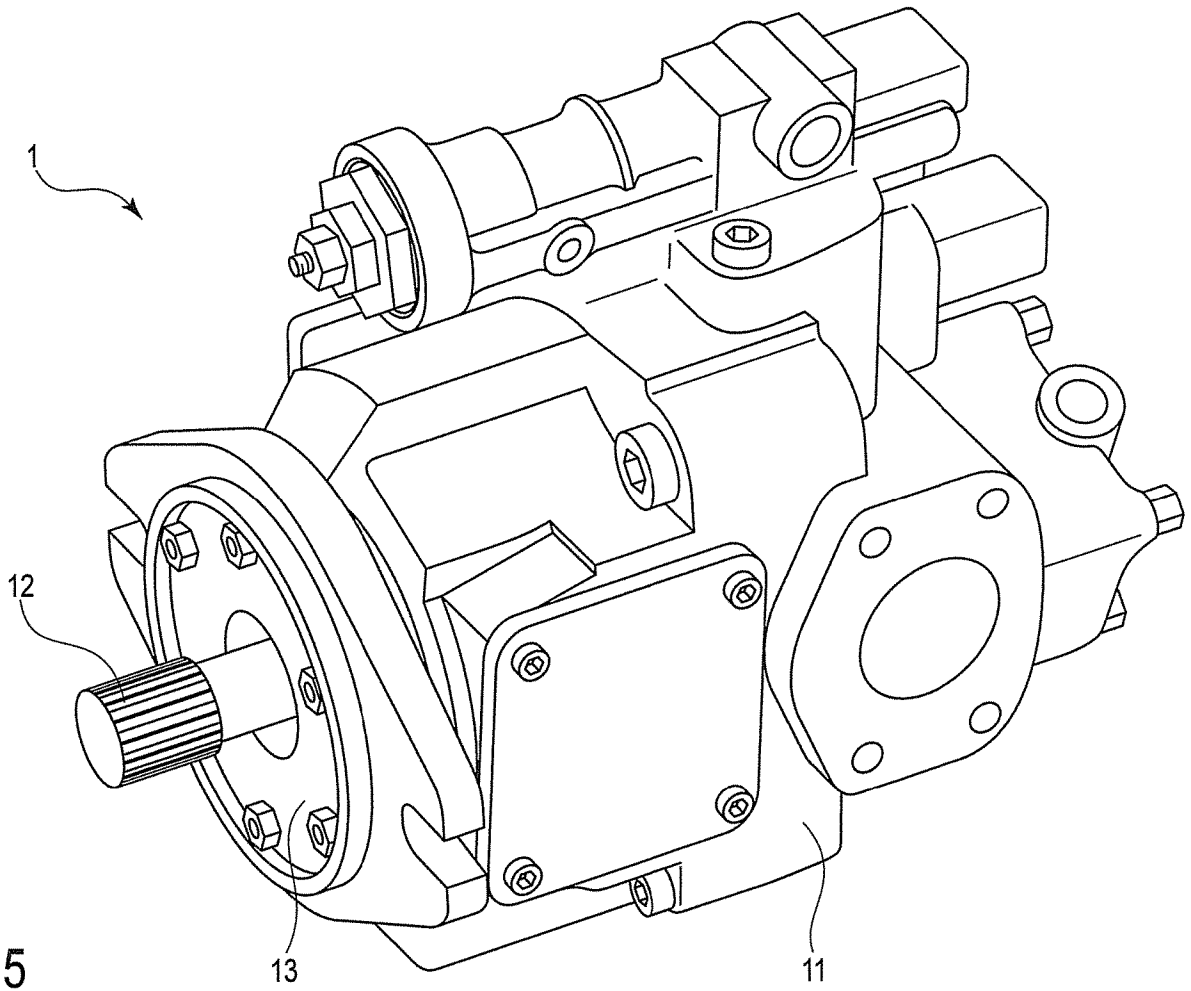
FIG. 5 is a schematic perspective view of a piston pump.

FIG. 5 is a schematic perspective view of a piston pump 1 equipped with a casing 11, shaft 12, and cylinder block 13. As an example of the part of the construction machine according to the embodiment of the present invention, the casing 11 can be made of one or more high-strength, high-damping-capacity cast iron products according to the embodiment of the present invention. Such a casing 11 has high vibration damping capacity and hence effectively suppresses noise of the piston pump 1.

Next, specific examples of the present invention will be explained together with comparative examples.

First, a molten metal was prepared using a high-frequency melting furnace. Then, pig iron, a carburizing agent, and ferromanganese were placed in a graphite crucible and melted. After that, the carbon amount and silicon amount were adjusted with ferrosilicon and the carburizing agent, and thus about 5 kg of molten metal were obtained. The Al amount of the obtained cast product was adjusted by adding aluminum ingot. The Sb amount and Sn amount were adjusted by adding pure antimony and pure tin. When adding RE, a commercially available misch metal (an alloy product in which the weight ratio of Ce:La was 2:1) was used as the RE source. Also, the melting temperature was set at about 1,450° C. A spheroidizing treatment and addition of an inoculant to the molten metal were performed in a ladle, and the molten metal was cast into a furan self-hardening mold of ϕ30×200 mm. Note that Ca+Ba was used as the inoculant. Furthermore, in Examples 12 and 13, in addition to the addition of the inoculant to the molten metal in the ladle, late inoculation was performed using Ca+Ba as inoculant.

The obtained cast product was worked into a size of 4×20×200 mm, and then evaluated for strength and vibration damping capacity. A tensile strength was obtained as an evaluation value of the strength. A tensile test was conducted by processing the cast product into a No. 4 specimen (JIS Z 2201), and evaluation was performed using a universal tester. Also, a logarithmic decrement was obtained as an evaluation value of the vibration damping capacity. A vibration testing method was according to JIS G 0602. Specifically, the test piece was suspended at two points and given $1\times10^{-4}\varepsilon$ of strain amplitude by an electromagnetic vibrator. The vibration was then stopped for free damping, and the logarithmic decrement was determined. The characteristics of the resulting cast products are shown in Tables 1 and 2 below, together with their compositions. Table 1 shows characteristics and compositions of the examples of the present invention, and Table 2 shows characteristics and compositions of conventional materials and the comparative examples.

Note that "high-strength cast iron" indicates cast iron whose tensile strength would be evaluated to be about 1.5 to 2.5 times that of FC300 (tensile strength=300 MPa). In the embodiment of the present invention, a tensile strength of 400 MPa or more is defined as high strength. Also, "high-damping cast iron" indicates cast iron whose damping performance would be evaluated to be about 2 to 4 times that of FCD450 (logarithmic decrement=20 to 30 $Np\times10^{-4}$). In the embodiment of the present invention, a logarithmic decrement of 40 $Np\times10^{-4}$ is defined as high damping. That is, according to an aspect of the present invention, high-strength, high-damping cast iron is cast iron having both a tensile strength of 400 Mpa or more and a logarithmic decrement of 40 $Np\times10^{-4}$ or more.

TABLE 1

| Sample | C (%) | Si (%) | Mn (%) | Sb (%) | Sn (%) | Al (%) | RE (%) | Ca + Ba (%) | P (%) | S (%) | Mg (%) | Tensile strength (MPa) | Logarithmic decrement ($10^{-4}$) | Heat treatment/ Inoculation |
|---|---|---|---|---|---|---|---|---|---|---|---|---|---|---|
| Example 1 | 3.2 | 1.3 | 0.3 | — | — | 4.9 | 0.019 | — | 0.02 | 0.01 | 0.05 | 444 | 49 | — |
| Example 2 | 3.3 | 2.3 | 0.3 | — | — | 6.0 | 0.019 | — | 0.02 | 0.01 | 0.05 | 663 | 54 | — |
| Example 3 | 3.5 | 2.0 | 0.3 | — | 0.1 | 5.8 | 0.019 | — | 0.02 | 0.01 | 0.05 | 575 | 56 | — |
| Example 4 | 3.5 | 2.0 | 0.3 | — | 0.1 | 5.8 | 0.019 | — | 0.02 | 0.01 | 0.05 | — | 77 | 900° C. Annealing |
| Example 5 | 3.5 | 2.0 | 0.3 | — | 0.1 | 5.8 | 0.019 | — | 0.02 | 0.01 | 0.05 | 544 | 85 | 1000° C. Annealing |
| Example 6 | 3.4 | 2.8 | 0.3 | — | 0.1 | 5.5 | 0.019 | — | 0.02 | 0.01 | 0.04 | 530 | 50 | — |
| Example 7 | 3.4 | 2.8 | 0.3 | — | 0.1 | 5.5 | 0.019 | — | 0.02 | 0.01 | 0.04 | — | 64 | 900° C. Annealing |
| Example 8 | 3.4 | 2.8 | 0.3 | — | 0.1 | 5.5 | 0.019 | — | 0.02 | 0.01 | 0.04 | 517 | 73 | 1000° C. Annealing |
| Example 9 | 3.2 | 2.3 | 0.5 | 0.4 | — | 4.9 | 0.019 | — | 0.02 | 0.01 | 0.04 | 530 | 45 | — |
| Example 10 | 3.2 | 2.3 | 0.5 | 0.4 | — | 4.9 | 0.019 | — | 0.02 | 0.01 | 0.04 | 500 | 71 | 900° C. Annealing |
| Example 11 | 3.2 | 2.5 | 0.3 | — | 0.1 | 4.8 | 0.019 | — | 0.02 | 0.01 | 0.04 | 460 | 43 | — |
| Example 12 | 3.2 | 2.6 | 0.3 | — | 0.1 | 4.8 | 0.019 | 0.002 | 0.02 | 0.01 | 0.04 | 443 | 58 | Late Inoculation |

TABLE 1-continued

| Sample | C (%) | Si (%) | Mn (%) | Sb (%) | Sn (%) | Al (%) | RE (%) | Ca + Ba (%) | P (%) | S (%) | Mg (%) | Tensile strength (MPa) | Logarithmic decrement ($10^{-4}$) | Heat treatment/ Inoculation |
|---|---|---|---|---|---|---|---|---|---|---|---|---|---|---|
| Example 13 | 3.2 | 2.5 | 0.3 | — | 0.1 | 5.0 | 0.019 | 0.004 | 0.02 | 0.01 | 0.04 | 452 | 61 | Late Inoculation |

EXAMPLES

Examples 1 and 2 are samples to which neither Sn nor Sb was added (the addition amount of each was 0.00%), and to which no heat treatment was performed. These samples satisfy the high strength and high damping performance defined in the above description.

Examples 3 and 6 are samples to which an appropriate amount of Sn was added, and Example 9 is a sample to which an appropriate amount of Sb was added. Like Examples 1 and 2, these samples satisfy the standards of the high-strength, high-damping cast iron.

Examples 4 and 5 are, examples in which cast products of the same composition as that of Example 3 were used to examine the effect of annealing. Similarly, Examples 7 and 8 are examples in which annealing was performed on the same cast product as that of Example 6. Example 10 is an example in which annealing was performed on the same cast product as that of Example 9. When annealing is performed at 900° C. or more, although the tensile strength slightly decreases, the logarithmic decrement improves. Also, the heat treatment temperature was 900° C. in Example 4, and the heat treatment temperature was 1,000° C. in Example 5. As indicated by a comparison of Example 4 and Example 5, by using a higher heat treatment temperature, the improving effect of the logarithmic decrement becomes even better. Comparison of Example 7 and Example 8 also shows a similar result.

In Example 11, the vibration damping capacity was relatively low. Example 12 is an example in which late inoculation was performed on a molten metal having the same composition as that of Example 11, using Ca+Ba as an inoculant. Example 13 is an example in which late inoculation was performed with the amount of inoculant increased. As shown in Table 1, by performing late inoculation, vibration damping capacity improved. The results of Examples 11 to 13 demonstrate that by late inoculation, variations in performance can be suppressed.

Conventional Examples

As is apparent from Table 2, there is not any cast iron having both a high strength and high damping performance among conventional materials.

Comparative Examples

Comparative Examples 1 and 2 are samples to which Al was added, but in which graphite was not spheroidized. That is, Comparative Example 1 and Comparative Example 2 are Al-added flaky graphite cast iron. These samples, which include flaky graphite, show high vibration damping performance, but have low tensile strength.

The addition amount of Sb exceeded 1% in Comparative Example 3, and the addition amount of Sn exceeded 0.5% in Comparative Example 4. In Comparative Example 3 and Comparative Example 4, shrinkage occurred, and cast iron having defect was obtained.

Comparative Example 5 is an example in which the addition amount of Al was less than 3%. As shown in Table 2, neither the tensile strength nor logarithmic decrement of Comparative Example 5 reaches the standards of the present invention.

As the above results indicate, in flaky graphite cast iron including a large amount of Al, i.e., Al-added flaky graphite cast iron, high strength could not be obtained. By spheroidizing graphite to thereby cast Al-added spheroidal graphite cast iron, high-strength, high-damping-capacity cast iron having a high strength was obtained.

The present invention is not limited by the very embodiments described above, an in the practice of the present invention, the composition of C, Si, Mn, P, S, Al, Sb, Sn, Mg, Re, Fe, or the like may be appropriately changed without departing from the gist of the present invention. Further, different compositions described in the embodiments may be appropriately used in combination.

Additional advantages and modifications will readily occur to those skilled in the art. Therefore, the invention in its broader aspects is not limited to the specific details and

TABLE 2

| Sample | C (%) | Si (%) | Mn (%) | Sb (%) | Sn (%) | Al (%) | RE (%) | Ca + Ba (%) | P (%) | S (%) | Mg (%) | Tensile strength (MPa) | Logarithmic decrement ($10^{-4}$) | Heat treatment/ Inoculation |
|---|---|---|---|---|---|---|---|---|---|---|---|---|---|---|
| Conventinal Example (equivalent to FC250) | 3.6 | 1.9 | 1.0 | — | — | — | — | — | 0.02 | 0.02 | — | 257 | 119 | — |
| Conventinal Example (equivalent to FC300) | 3.3 | 1.8 | 0.9 | — | — | — | — | — | 0.02 | 0.02 | — | 321 | 79 | — |
| Conventinal Example (equivalent to FCD400) | 3.7 | 2.6 | 0.3 | — | — | — | — | — | ≤0.03 | ≤0.03 | 0.05 | 399 | 36 | — |
| Conventinal Example (equivalent to FCD450) | 3.7 | 2.5 | 0.4 | — | — | — | — | — | ≤0.03 | ≤0.03 | 0.05 | 450 | 23 | — |
| Comparative Example 1 | 3.0 | 1.9 | 0.8 | — | — | 6.1 | — | — | 0.02 | 0.01 | — | 235 | 221 | — |
| Comparative Example 2 | 3.0 | 1.9 | 0.8 | — | — | 5.6 | — | — | 0.02 | 0.01 | — | 215 | 305 | — |
| Comparative Example 3 | 3.2 | 2.3 | 0.3 | 1.1 | — | 5.6 | 0.02 | — | 0.02 | 0.01 | 0.04 | 356 | — | Defect |
| Comparative Example 4 | 3.2 | 2.3 | 0.3 | — | 0.52 | 5.6 | 0.02 | — | 0.02 | 0.01 | 0.04 | 330 | — | Defect |
| Comparative Example 5 | 3.7 | 2.5 | 0.4 | — | — | 2.8 | 0.019 | — | 0.01 | 0.01 | 0.05 | 395 | 34 | — |

representative embodiments shown and described herein. Accordingly, various modifications may be made without departing from the spirit or scope of the general inventive concept as defined by the appended claims and their equivalents.

What is claimed is:

1. A high-strength, high-damping-capacity cast iron obtained by a method including performing a graphite spheroidizing treatment on a molten metal, and consisting of 2 wt % to 4 wt % of C, 1 wt % to 5 wt % of Si, 0.2 wt % to 0.9 wt % of Mn, 0.1 wt % or less of P, 0.1 wt % or less of S, 4.8 wt % to 6.0 % wt of Al, 0.2 wt % to 1 wt % of Sb, 0 wt % to 0.5 wt % of Sn, 0.02 wt % to 0.10 wt % of Mg, 0.001 wt % to 0.500 wt % of RE consisiting of Ce and/or La at an arbitrary ratio, Fe as balance, and unavoidable impurity.

2. The high-strenght, high-damping-capacity cast iron according to claim 1, wherein a content of Sb is 0.5 wt % to 1 wt %.

3. The high-strength, high-damping-capacity cast iron according to claim 1, wherein a content of RE is 0.001 wt % to 0.050 wt %.

4. A high-strength, high-damping-capacity cast iron consisting of 2 wt % to 4 wt % of C, 1 wt % to 5 wt % of Si, 0.2 wt % to 0.9 wt % of Mn, 0.1 wt % or less of P, 0.1 wt % or less of S, 3 wt % to 7 wt % of Al, 0 wt % to 1 wt % of Sb, 0 wt % to 0.5 wt % of Sn, 0.02 wt % to 0.10 wt % of Mg, 0.001 wt % to 0.500 wt % of RE consisting of Ce and/or La at an arbitrary ratio, 0.0001 wt % to 0.01 wt % of an inoculant consisting of Ca and/or Ba at an arbitrary ratio, Fe as balance, and unavoidable impurity, the cast iron being obtained by a method including performing a graphite spheroidizing treatment on a molten metal, the method including an inoculation treatment of adding the inoculant to the molten metal.

5. The high-strength, high-damping-capacity cast iron according to claim 4, wherein the inoculation treatment includes late inoculation.

6. The high-strength, high-damping-capacity cast iron according to claim 1, wherein the method further includes performing at 900° C. or more, quenching, normalizing, or annealing.

7. The high-strength, high-damping-capacity cast iron according to claim 1, wherein the method further includes performing at 1,000° C. or more, quenching, normalizing, or annealing.

8. The high-strength, high-damping-capacity cast iron according to claim 1, wherein a spheroidization ratio of graphite resulting from the graphite spheroidizing treatment is 40% or more.

9. A cast iron part made of high-strength, high-damping-capacity cast iron according to claim 1.

10. The cast iron part according to claim 9, wherein the cast iron part is a part of a construction machine.

11. The cast iron part according to claim 9, wherein the cast iron part is a hydraulic part.

12. The high-strength, high-damping-capacity cast iron according to claim 4, wherein the content of Sb is 0.2 wt % to 1 wt % or a content of Sn is 0.1 wt % to 0.5 wt %.

13. The high-strength, high-damping-capacity cast iron according to claim 4, wherein the content of Al is 4.8 wt % to 6.0 wt %.

14. A high-strength, high-damping-capacity cast iron obtained by a method including performing a graphite spheroidizing treatment on a molten metal, and consisting of 2 wt % to 4 wt % of C, 1 wt % to 5 wt % of Si, 0.2 wt % to 0.9 wt % of Mn, 0.1 wt % or less of P, 0.1 wt % of less of S, 4.8 wt % to 6.0 wt % of Al, 0 wt% to 1 wt % of Sb, 0.1 wt % to 0.5 wt % of Sn, 0.02 wt % to 0.10 wt % of Mg, 0.001 wt % to 0.500 wt % of RE consisting of Ce and/or La at an arbitrary ratio, Fe as balance, and unavoidable impurity.

15. A cast iron part made of high-strength, high-damping-capacity cast iron according to claim 4.

16. A cast iron part made of high-strength, high-damping-capacity cast iron according to claim 14.

* * * * *